United States Patent [19]

Benthin

[11] 4,068,325

[45] Jan. 17, 1978

[54] SPRAYING DEVICE FOR USE IN TOILETS

[75] Inventor: Johannes Benthin, Bremerhaven, Germany

[73] Assignee: MFB-Neuwerk Mechanische Fensterbehange GmbH, Bremerhaven, Germany

[21] Appl. No.: 722,213

[22] Filed: Sept. 10, 1976

[30] Foreign Application Priority Data

Sept. 13, 1975 Germany ..... 2540927

[51] Int. Cl.[2] ..... A47K 11/08; A47K 3/22

[52] U.S. Cl. ..... 4/7; 4/6

[58] Field of Search ..... 4/6, 7, 145

[56] References Cited

U.S. PATENT DOCUMENTS

| | | | |
|---|---|---|---|
| 1,866,930 | 7/1932 | Guidetti et al. | 4/7 |
| 1,887,679 | 11/1932 | Guidetti et al. | 4/7 |
| 1,949,415 | 3/1934 | Guidetti et al. | 4/7 |
| 2,722,014 | 11/1955 | Bonomolo | 4/7 |
| 3,651,523 | 3/1972 | Miyahara et al. | 4/145 |

*Primary Examiner*—Henry K. Artis
*Attorney, Agent, or Firm*—Michael J. Striker

[57] ABSTRACT

A spraying device includes a support arm mounted in a toilet bowl for pivoting between a retracted and an extended position at one of its ends, and carrying a spraying head at the other end. The spraying head has two compartments which are sealingly separated from one another, each of the compartments communicating with a different set of spraying apertures, one of the sets having a larger flow-through cross-sectional area than the other set. Separate conduits communicate a control valve to which a spraying liquid is delivered, with each of the compartments to issue through the two sets of apertures at different speeds in proportion to the different flow-through cross-sectional areas of the two sets. The control valve may be incorporated in the holder for the support arm, and the apertures of the two sets may aim in different directions, respectively. The compartment communicating with the set of larger total flow-through cross-sectional area may circumferentially surround the other compartment and its apertures may be inclined in the upward and frontward direction of the toilet bowl when the support arm is in its extended position in which the control valve is open.

12 Claims, 7 Drawing Figures

SPRAYING DEVICE FOR USE IN TOILETS

BACKGROUND OF THE INVENTION

The present invention relates to spraying devices in general, and particularly to spraying devices for use in toilet bowls. There are already known various spraying devices, such as hand-held or wall-mounted showerheads and the like. It is also already known to mount such spraying devices for pivoting between a plurality of positions when they are wall-mounted, mainly for the purpose of directing the spraying liquid, such as water at selected temperature, on the body of the user of the spraying device. It is well known from the context of such spraying devices as showers that the water is admitted into the showerhead through a pipe or even a flexible hose or the like.

On the other hand, it is also known to use spraying devices of the type here under consideration in toilets, in which event such spraying devices are mounted in the toilet bowl, on the toilet seat, or on a separate intermediate ring-shaped member, and such spraying devices usually include a spraying head which is mounted on a support arm for pivoting between a retracted position in which the spraying device is protected from soiling, and an extended position which is the position of use of such spraying device. Instead of pivoting, the spraying device may be mounted in the toilet bowl, on the intermediate ring or on the toilet seat for displacement longitudinally of itself or in any similar manner.

The spraying head of such a conventional type of spraying devices has a plurality of openings which are directed upwardly so that the spraying liquid, such as water which is usually pre-heated to a comfortable temperature in a pre-heating device issues from the spraying head in the generally upward direction. In such conventional devices, the pre-warmed water exits from the spraying head at a constant pressure and at a constant volumetric rate during the entire spraying or cleaning operation. Experience has shown, however, that this situation does not correspond to the actual requirements, especially since the region of the body of the user which is to be cleaned by means of the spraying device should not, if at all possible, be limited to the immediate anal area, but rather should also include the surrounding regions of the buttocks and at least parts of the external genitals of persons of both sexes. When the area being sprayed by the conventional spraying device is extended in the above discussed manner, the water streams which issue from the conventional spraying head through a single or a plurality of spraying apertures impinge with the same intensity upon tissues or body parts of different sensitivities. This, of course, is a very disadvantageous situation.

SUMMARY OF THE INVENTION

Accordingly, it is a general object of the present invention to avoid the disadvantages of the prior-art spraying devices.

More particularly, it is an object of the present invention to provide a spraying device for use in toilets which is not possessed of the above-discussed disadvantages of the prior-art spraying devices of this type.

Yet another object of the present invention is to provide a spraying device of the type here under consideration which achieves an excellent cleaning action.

It is still another object of the present invention to so construct a spraying device for use in toilets that the water which issues therefrom during the use of such spraying device impinges at different speeds upon tissues of different sensitivities.

A concomitant object of the present invention is to provide a spraying device which is simple in construction and reliable in operation.

In pursuance of these objects and others which will become apparent hereafter, one feature of the present invention resides, in a spraying device, particularly for use in toilets, briefly stated, in a spraying head which includes external wall means bounding a chamber and having at least one first and one second spraying aperture communicating the above-mentioned chamber with the exterior of the spraying head, and internal wall means which subdivides the chamber into at least two compartments which are sealed with respect to one another and which communicate with the first and the second spraying aperture, respectively; and means for admitting spraying liquid into each of the compartments to issue therefrom through the respective spraying aperture. Preferably, the spraying device further comprises means for mounting the spraying head in a toilet bowl, including a support arm, the above-mentioned admitting means including a main conduit and at least two branch conduits each communicating the main conduit with one of the above-mentioned compartments, the branch conduits being supported by and extending along the support arm, preferably within the confines of the latter.

As a result of the subdivision of the internal chamber of the spraying head into two compartments, and also of the provision of separate branch conduits each communicating the main conduit with one of the compartments, it is possible to let the spraying liquid, such as prewarmed water, issue from one of the compartments through its aperture at a different speed than from the other compartment through the associated aperture of the latter, particularly by maintaining the pressure within one of the compartments at a different value than in the other compartment.

This effect can be achieved in a very simple manner and without any complex pressure-regulating arrangement by making the flow-through cross-sectional area of one of the apertures larger than the flow-through cross-sectional area of the other aperture which communicates with a different compartment than the first-mentioned aperture.

The external wall means may have a plurality of additional first and second spraying apertures which communicate with the above-mentioned compartments, respectively. In this event, the above-mentioned first spraying apertures may have a total flow-through cross-sectional area which exceeds that of the above-mentioned second spraying apertures.

Under these circumstances, the spraying liquid, that is water, may be admitted into each of the compartments at the same pressure through the respective branch conduit, but the speed at which the spraying water will issue through the respective apertures from the two compartments will be proportionate to the respective flow-through cross-sectional area of the first aperture or apertures and second aperture or apertures, respectively. This is due to the fact that the pressure drop across the external wall of the spraying head which bounds the respective compartment and which is provided with the respective spraying aperture or apertures is a function of the flow-through cross-sectional area of such aperture or of the total flow-through cross-sectional area of such apertures.

According to a further aspect of the present invention, valve means may be interposed between the main conduit and the branch conduits and may control the admission of spraying liquid into the branch conduits. The mounting means may include at least one pivot which mounts the support arm at the toilet bowl for pivoting between a retracted inoperative, and an extended operative, position, the valve means being connected to the support arm and operative for closing in the retracted position and for opening in the extended position. The mounting means may further include a holder for the pivot, and the valve may be incorporated in the holder and partly formed by the same.

The valve may be so constructed that streams of spraying liquid may be ejected from one of the compartments through its associated aperture or apertures and/or from the other compartment through the associated aperture or apertures thereof, depending on the position assumed by the support arm of the spraying device.

An especially advantageous arrangement is obtained when the aperture or apertures of one of the sets have different inclinations than the aperture or apertures of the other set. In this manner, it is possible to pivot the support arm only to such an extent toward the extended position that the spraying liquid is ejected at a high pressure and at a high speed through the spraying apertures of the set of apertures of a smaller flow-through cross-sectional area for the cleaning of the immediate anal area of the body of the user of the spraying device. Afterwards, but only after the spraying device and the support arm thereof have reached or closely approached its fully extended position, water is admitted into the other compartment to issue from the spraying apertures of the larger flow-through cross-sectional area, but the water which issues from the apertures of this other set will come into contact with different areas of the body of the user owing to the different inclination of such apertures of the other set from those of the first-mentioned set of apertures.

According to a further concept of the present invention, the axes of the apertures of the larger flow-through cross-sectional area are inclined in the upward and forward direction in the extended pivoted position of the support arms, so that the water which issues from such larger-area apertures at a lower speed than from the smaller-area apertures sprays the regions of the external genitals and results in a gentle cleaning which is very important for these regions.

A particularly advantageous spraying head is obtained by so constructing the interior of the spraying head and the partitioning wall therein that the compartment which communicates with the apertures of the smaller flow-through cross-sectional area is circumferentially surrounded in a coaxial fashion by the compartment which communicates with the apertures of the larger total cross-sectional area. This arrangement brings about a very important advantage in that a larger number of the apertures which communicate with the outer compartment can be provided in the external wall than the number of the apertures which communicate with the internal compartment, given by the geometry of the spraying head and particularly the fact that the outer compartment is, of necessity, larger in the circumferential direction than the inner compartment.

As already mentioned above, the admission of the spraying water into the two compartments can be controlled by the above-discussed control valve which is arranged upstream of the branch conduits in or on the support arm and which is preferably controlled by the movement of the support arm between the retracted and extended position thereof, or as a direct consequence thereof. Such a control valve will be discussed in more detail later on.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
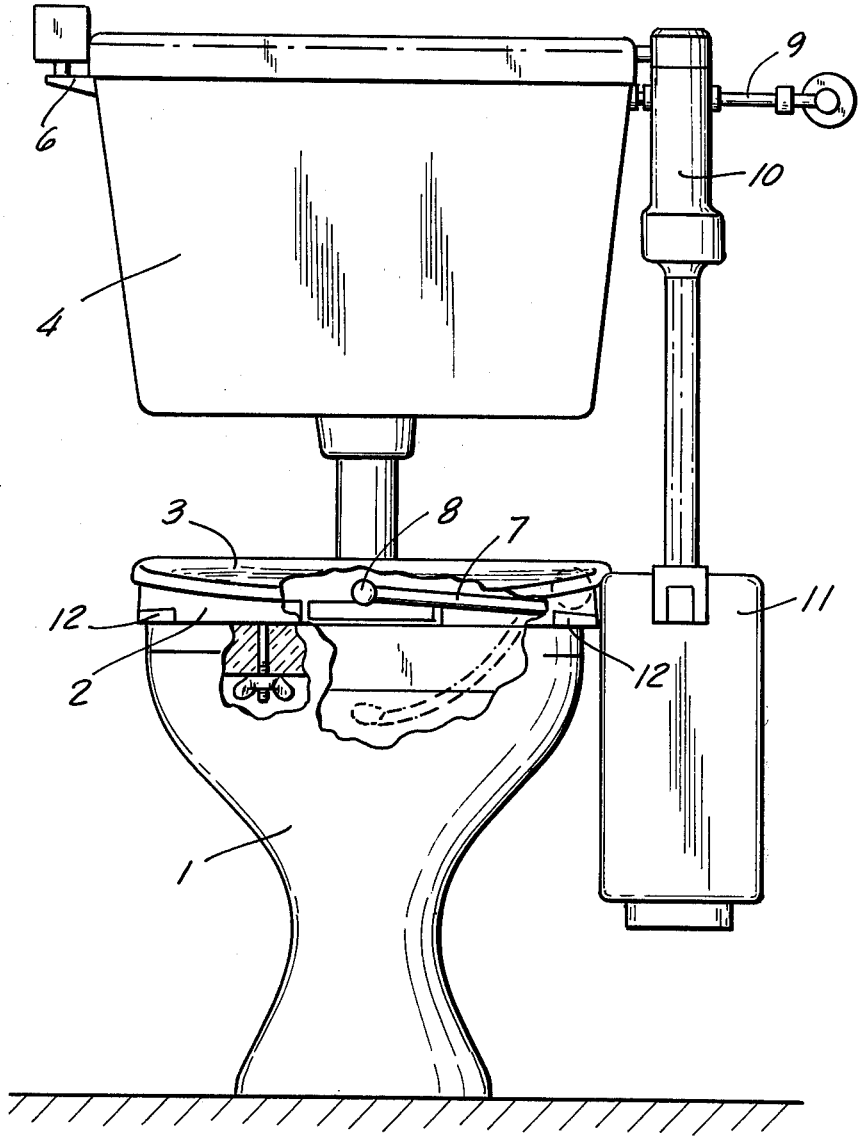
FIG. 1 is a partly sectioned front elevational view of a toilet in which the spraying device of the present invention is incorporated.

Referring now to the drawings, and first to FIG. 1 thereof, it may be seen therein that the toilet in which the present invention is used includes a toilet bowl 1 on which there is mounted a toilet seat 2 for pivoting about a horizontal axis. The opening of the toilet seat 2 can be closed or covered by a tiltable lid 3. FIG. 1 further illustrates, in a rather diagrammatic manner, some elements of the flushing arrangement of the toilet, which includes a container 4 which communicates with the toilet bowl 1 by means of conduit 5 at the actuation of a flushing lever 6. The flushing arrangement is of conventional construction and, as known, it includes a bouyant body which controls the flushing operation after the actuation of the lever 6, and the subsequent filling of the container 4.

The toilet of FIG. 1 further includes a spraying arrangement of the present invention which includes a support arm 7 on the free end of which there is mounted a spraying head 8. The support arm 7 is mounted on the toilet in any conventional manner, such as on the toilet bowl 1, on the seat 2, or on a non-illustrated intermediate ring-shaped element, for pivoting between a retracted position which is illustrated in FIG. 1 in full lines and in which the spraying device is protected from soiling, and an extended position which is shown in FIG. 1 in broken lines. However, instead of pivoting, the spraying device could also be mounted on the toilet for displacement longitudinally of itself between the above-mentioned retracted and extended positions thereof.

The water is delivered to the spraying device of the present invention by means of a main conduit 9 in which there is interposed a control valve 10, and through a preheating device 11. A pair of actuating levers 12 is arranged, one at each side of the toilet seat 2, which serve the purpose of triggering and actuating the spraying device of the present invention.

Figure 2:
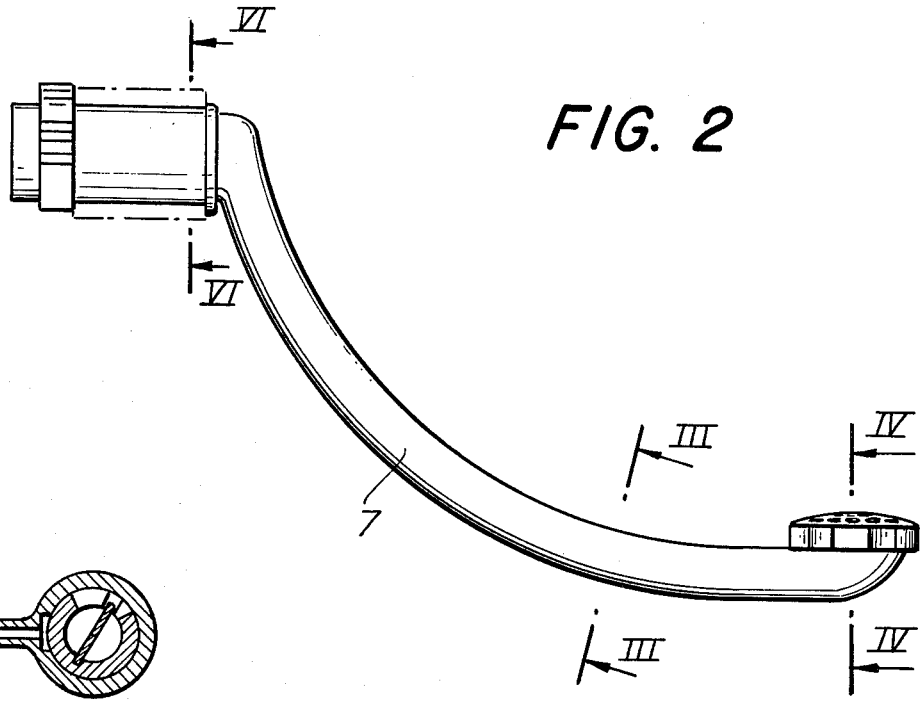
FIG. 2 is a side elevational view of a support arm shown in FIG. 1 at an enlarged scale.

The spraying device of the invention is shown in more detail in FIG. 2, and the details thereof can be ascertained from FIGS. 3 to 7. As seen in particular in FIG. 3, the support arm 7 is hollow and is formed with two channels or branch conduits 13 and 14. The channels 13 and 14 lead all the way into the spraying head 8, as seen particularly in FIG. 4 which also shows that the spraying head 8 has two compartments designated with reference numerals 15 and 16, respectively. The compartments 15 and 16 communicate with the respective conduits 13 and 14 and are sealingly separated from one another by partition walls.

One of the compartments, namely the compartment 15, is arranged centrally of the spraying head 8 and is concentrically surrounded by the other compartment 16. The central compartment 15 has spraying apertures 17 which are considerably fewer in number than other apertures 18 which communicate with the outer compartment 16, as seen in particular in FIG. 5.

Figure 4:
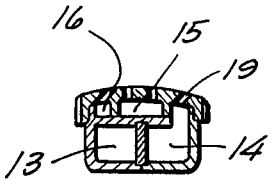
FIG. 4 is a sectional view taken on line IV—IV of FIG. 2.

As illustrated in FIG. 4, the apertures 18 have axes 19 which are considerably inclined with respect to the central axis of the spraying head 8 and, for that matter, with respect to the spraying apertures 17. The axes 19 of the spraying apertures 18 are inclined in such a manner that, when the spraying device is in its extended position, these axes 19 are inclined forwardly of the toilet bowl 1 and aim at the person using the toilet. In particular, these apertures 18 are directed against the region of the extenal genitals of the user of the toilet. As a result of the larger number, and thus of the larger total flow-through cross-sectional area, of the spraying apertures 18, the water which is ejected through such spraying apertures 18 reaches the area of the body of the user against which these apertures 18 are aimed at a relatively low speed and low pressure, as required, particularly when the user is of the female sex.

On the other hand, the water issues at a much higher pressure and higher speed from the spraying apertures 17 of the central chamber 15, these spraying apertures 17 being predominantly directed against the anal region of the user.

Figure 7:
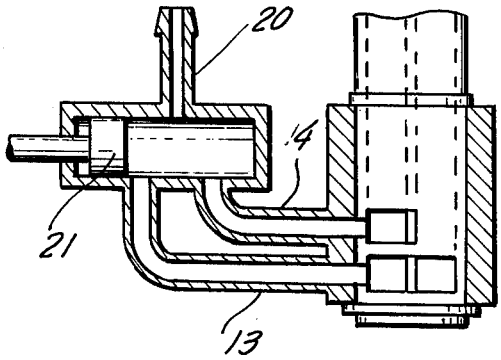
FIG. 7 is a sectional view of a control valve which can be used in the present invention.
Figure 5:
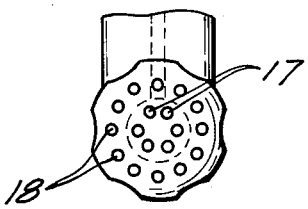
FIG. 5 is a top elevational view of the spraying head of the present invention.

The admission of the water into the compartments 15 and 16 through the conduits 13 and 14 may be controlled by a multi-port multi-position valve which, as illustrated in FIG. 7, may be constructed in a manner resembling a cylinder-and-piston unit. In other words, the valve may include an inlet nipple 20 which communicates with a chamber in which there is mounted for reciprocation a piston 21 which controls the admission of the sprayed water into the respective branch conduits 13 and 14. When the piston 21 is in an unillustrated central position, it interrupts communication of the inlet nipple 20, which, in turn, communicates with the main conduit from the pre-heating unit 11, with the chamber of the valve so that the spraying water cannot reach either of the branch conduits 13 and 14. When the valve piston 21 is moved to one or the other side of the above-mentioned central position, water will be admitted from the inlet nipple 20 into the chamber of the valve to one or to the other side of the piston 21 and, consequently, will flow into one or the other of the branch conduits 13 and 14, depending on the position of the piston 21. In the illustrated position of the piston 21, water can simultaneously flow into both of the conduits 13 and 14, and, thus, into both of the compartments 15 and 16. From these compartments 15 and 16, respectively, the water admitted thereinto by the control valve in the above-discussed manner depending on the position of the piston 21, issues through the spraying openings 17 or 18. It will be appreciated that when the piston 21 is in the illustrated position, that is, when the water is admitted into both of the channels or conduits 13 and 14, the flow-through cross-sectional areas of the apertures 17 and 18 will be added to each other so that, because of the fact that the nipple 20 has a given flow-through cross-sectional area, the pressure in the respective compartment 15 or 16 will be much lower than in the event that no water is admitted into the other compartment 16 or 15. As a result of this, the speed and pressure at which the water issues from the sets of spraying apertures 17 and 18, that is, each of these sets, can be controlled in this relatively simple manner so that, if so desired, both sets of spraying apertures 17 and 18 could have the same flow-through cross-sectional area, the force of impact of the water sprays on the tissues of different sensitivities being solely controlled by the admission or non-admission of the spraying water into the outer compartment 16.

Figure 6:
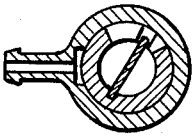
FIG. 6 is a sectional view taken on line VI—VI of FIG. 2.
Figure 3:
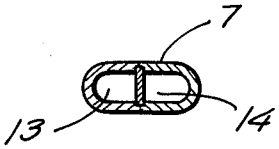
FIG. 3 is a sectional view taken on line III—III of FIG. 2.

FIG. 6 illustrates, in cross-section, a combination of a multi-port multi-position valve with a holder which pivotally mounts the support arm 7 of the spraying device. The holder is designated with the reference numeral 22 and, as may be seen in FIG. 6, it simultaneously forms the housing for the multi-port multi-position valve.

It will be understood that each of the elements described above, or two or more together, may also find a useful application in other types of constructions differing from the types described above.

While the invention has been illustrated and described as embodied in a spraying device for use in toilets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A spraying device, particularly for use in toilets, comprising a spraying head including external wall means bounding a chamber and having at least one first and one second spraying aperture communicating said chamber with the exterior of said spraying head, and internal wall means subdividing said chamber into at least two compartments sealed with respect to one another and communicating with said first and said second spraying aperture, respectively; means for admitting spraying liquid into each of said compartments to issue therefrom through the respective spraying aperture; and means mounting said spraying head in a toilet bowl movable relative to the latter and operative for moving said spraying head between a first position in which the spraying liquid is admitted into one of said compartments to issue therefrom through said first aperture and a second position in which the spraying liquid is admitted into at least the other compartment to issue therefrom through said second aperture.

2. A spraying device as defined in claim 1, wherein said external wall means has a plurality of additional first and second spraying apertures communicating with said compartments, respectively.

3. A spraying device as defined in claim 1, wherein said mounting means are operative for admitting the spraying liquid in said second position of said spraying head additionally into said one compartment so that the spraying liquid in said second position issues both through said first and said second apertures.

4. A spraying device as defined in claim 2, wherein said first spraying apertures have a combined flow-through cross-sectional area which exceeds the combined flow-through cross-sectional area of said second spraying apertures so that the spraying liquid issuing through said first spraying apertures has a pressure and speed less than those of the spraying liquid issuing from said second spraying apertures and thereby performs a more gentle cleaning action than the latter.

5. A spraying device as defined in claim 4 wherein at least some of said first spraying apertures are inclined in the frontward direction of the toilet bowl and upwardly.

6. A spraying device as defined in claim 2, wherein one of said compartments circumferentially surrounds the other compartment.

7. A spraying device as defined in claim 6, wherein said one compartment communicates with said first spraying apertures, and the other compartment communicates with said second spraying apertures.

8. A spraying device as defined in claim 1, wherein said means mounting said spraying head in a toilet bowl include a support arm; and wherein said admitting means includes a main conduit and at least two branch conduits each communicating said main conduit with one of said compartments, said branch conduits being supported by and extending along said support arm.

9. A spraying device as defined in claim 8; and further comprising valve means interposed between said main conduit and said branch conduits and operative for controlling the admission of the spraying liquid into said branch conduits.

10. A spraying device as defined in claim 9, wherein said mounting means further includes at least one pivot mounting said support arm at the toilet bowl for pivoting between a retracted inoperative, and an extended operative, positions; and wherein said valve means is connected to said support arm and operative for closing in said retracted position and for opening in said extended position.

11. A spraying device as defined in claim 10, wherein said mounting means further includes a holder for said pivot; and wherein said valve is incorporated in said holder and is partly formed by the same.

12. A spraying device as defined in claim 4, wherein said first spraying apertures extend in different directions from said first spraying apertures.

* * * * *